US008096452B1

(12) United States Patent
Rogers

(10) Patent No.: US 8,096,452 B1
(45) Date of Patent: Jan. 17, 2012

(54) CLOTHING WRINKLE REMOVAL APPARATUS AND METHOD

(76) Inventor: Dwight D. Rogers, Young Harris, GA (US)

( * ) Notice: Subject to any disclaimer, the term of this patent is extended or adjusted under 35 U.S.C. 154(b) by 797 days.

(21) Appl. No.: 12/177,542

(22) Filed: Jul. 22, 2008

(51) Int. Cl.
*A42C 1/08* (2006.01)

(52) U.S. Cl. ..... 223/21

(58) Field of Classification Search ..... 223/21; 38/144

See application file for complete search history.

(56) References Cited

U.S. PATENT DOCUMENTS

| | | | | |
|---|---|---|---|---|
| 4,413,167 | A | 11/1983 | Martel et al. | |
| 4,439,656 | A | 3/1984 | Peleg | |
| 4,560,850 | A | 12/1985 | Levendusky et al. | |
| 4,705,927 | A | 11/1987 | Levendusky et al. | |
| 4,853,509 | A * | 8/1989 | Murakami | 219/731 |
| 5,154,303 | A * | 10/1992 | Jordan | 220/23.86 |
| 5,370,042 | A | 12/1994 | Tolchin et al. | |
| 5,459,301 | A * | 10/1995 | Miller et al. | 219/679 |
| D391,440 | S | 3/1998 | Cousins | |
| 5,947,008 | A * | 9/1999 | Fullmer | 99/342 |
| 6,175,105 | B1 | 1/2001 | Rubbright et al. | |
| 6,309,684 | B2 * | 10/2001 | Hopkins, Sr. | 426/234 |
| D475,571 | S * | 6/2003 | Hopkins | D7/359 |
| 6,803,551 | B2 | 10/2004 | Kim et al. | |
| 7,066,950 | B2 * | 6/2006 | Jung, Jr. | 607/114 |
| 2005/0049163 | A1 * | 3/2005 | Akbarian et al. | 510/285 |
| 2006/0177342 | A1 * | 8/2006 | Bauer | 422/26 |

* cited by examiner

*Primary Examiner* — Shaun R Hurley

(57) ABSTRACT

A clothing wrinkle removal apparatus includes a housing that has a bottom wall and a perimeter wall that is attached to and extends upwardly from the bottom wall. The housing includes a cover that is removably coupled to the perimeter wall to cover an access opening into the housing defined by an upper edge of the perimeter wall. The housing has an air passage opening therein. An item of clothing is positioned within the housing with a quantity of water and placed in a microwave oven with the cover on the housing. The microwave is turned on to heat the water and the item of clothing to remove wrinkles from the item of clothing.

8 Claims, 7 Drawing Sheets

CLOTHING WRINKLE REMOVAL APPARATUS AND METHOD

BACKGROUND OF THE INVENTION

Field of the Invention

The present invention relates to wrinkle removing devices and more particularly pertains to a new wrinkle removing device for assisting a person in removing wrinkles from clothing.

SUMMARY OF THE INVENTION

The present invention meets the needs presented above by generally comprising a housing that has a bottom wall and a perimeter wall that is attached to and extends upwardly from the bottom wall. The housing includes a cover that is removably coupled to the perimeter wall to cover an access opening into the housing defined by an upper edge of the perimeter wall. The housing has an air passage opening therein. An item of clothing is positioned within the housing with a quantity of water and placed in a microwave oven with the cover on the housing. The microwave is turned on to heat the water and the item of clothing to remove wrinkles from the item of clothing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
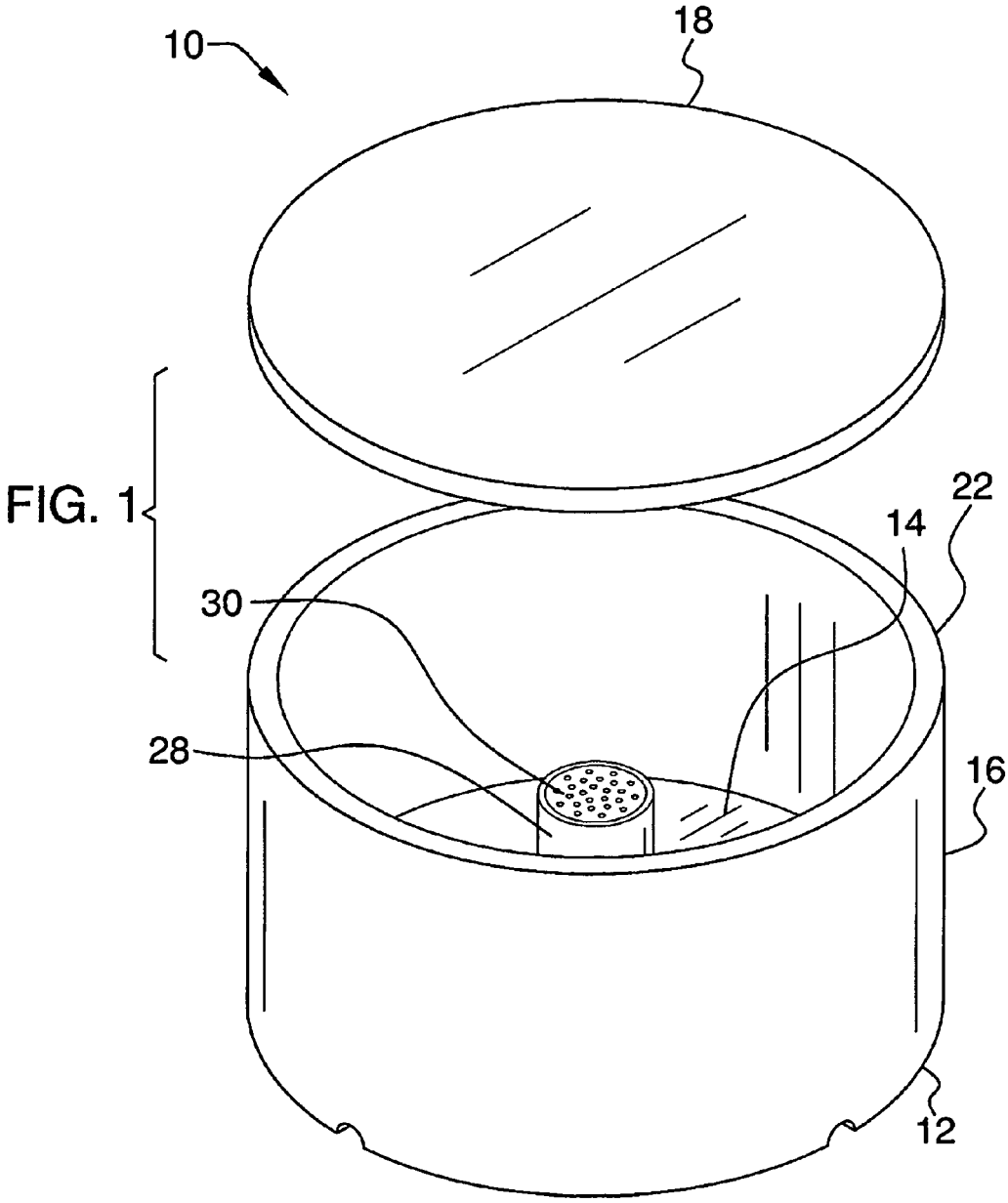
FIG. 1 is a top perspective view of a clothing wrinkle removal apparatus and method according to the present invention.
Figure 2:
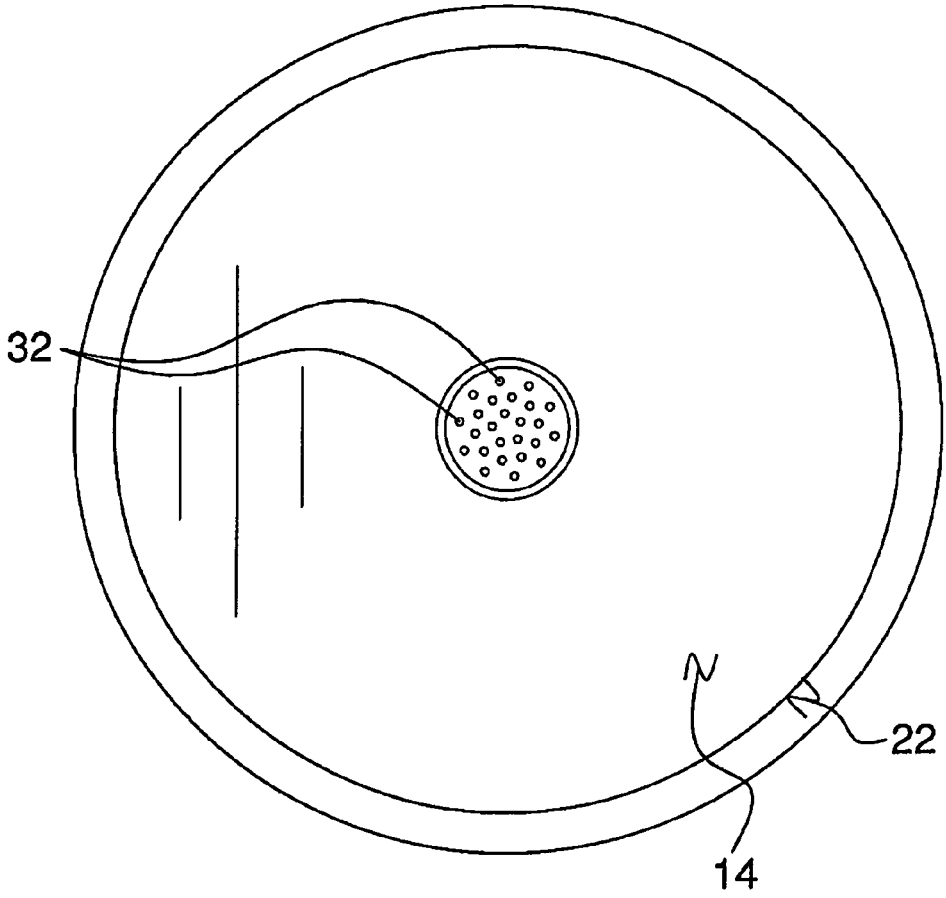
FIG. 2 is a top view of a housing of the present invention.
Figure 3:
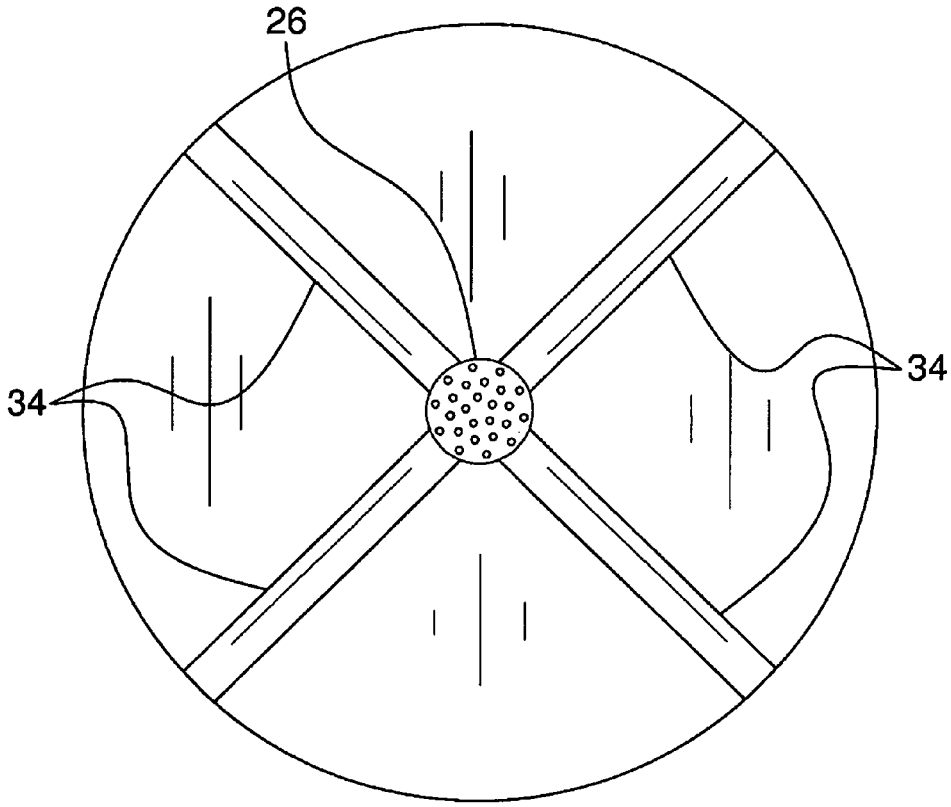
FIG. 3 is a bottom view of the present invention.
Figure 4:
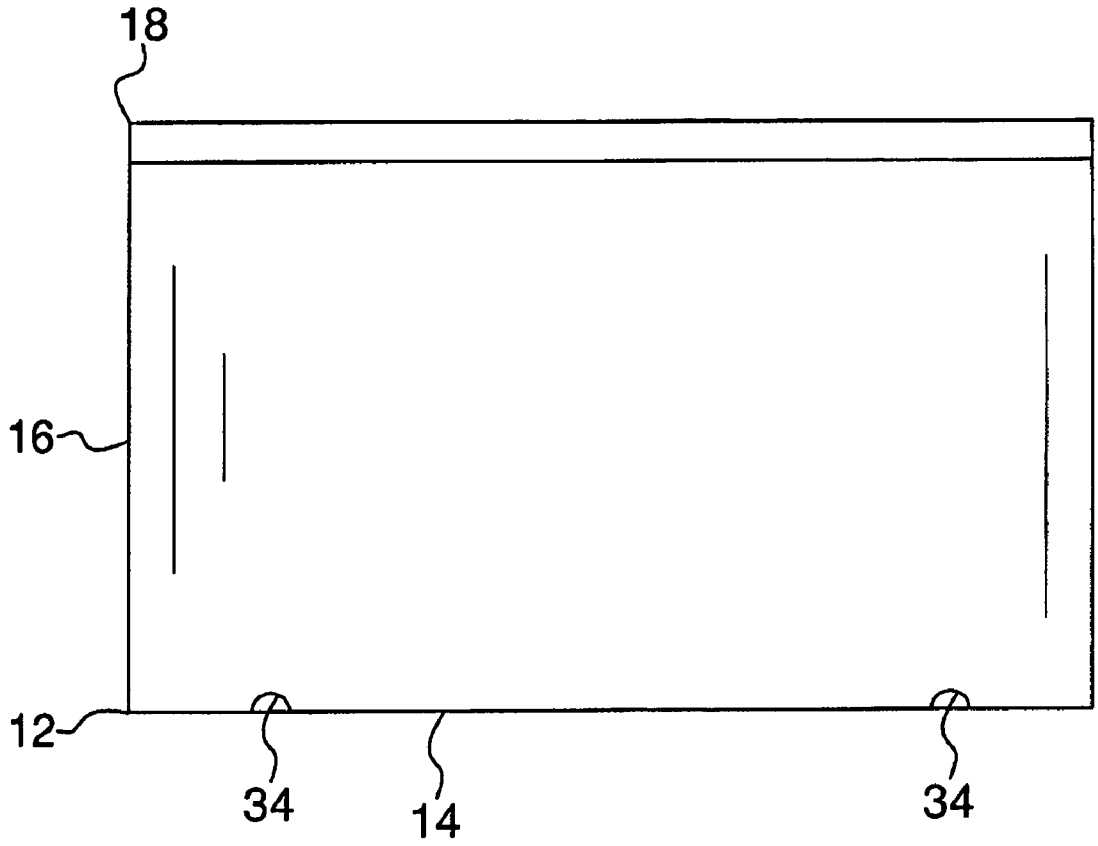
FIG. 4 is a side view of the present invention.
Figure 5:
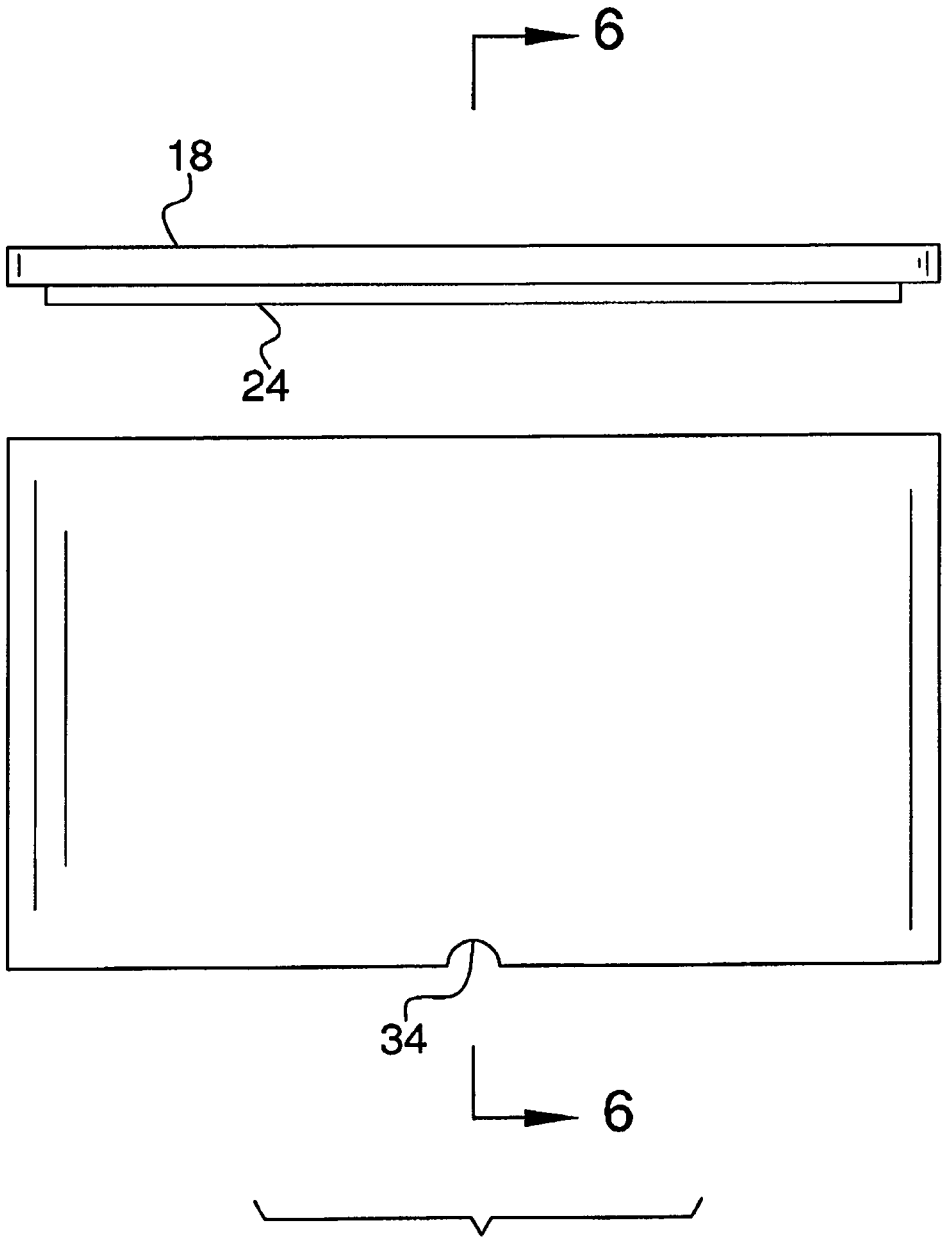
FIG. 5 is a front expanded view of the present invention.
Figure 6:
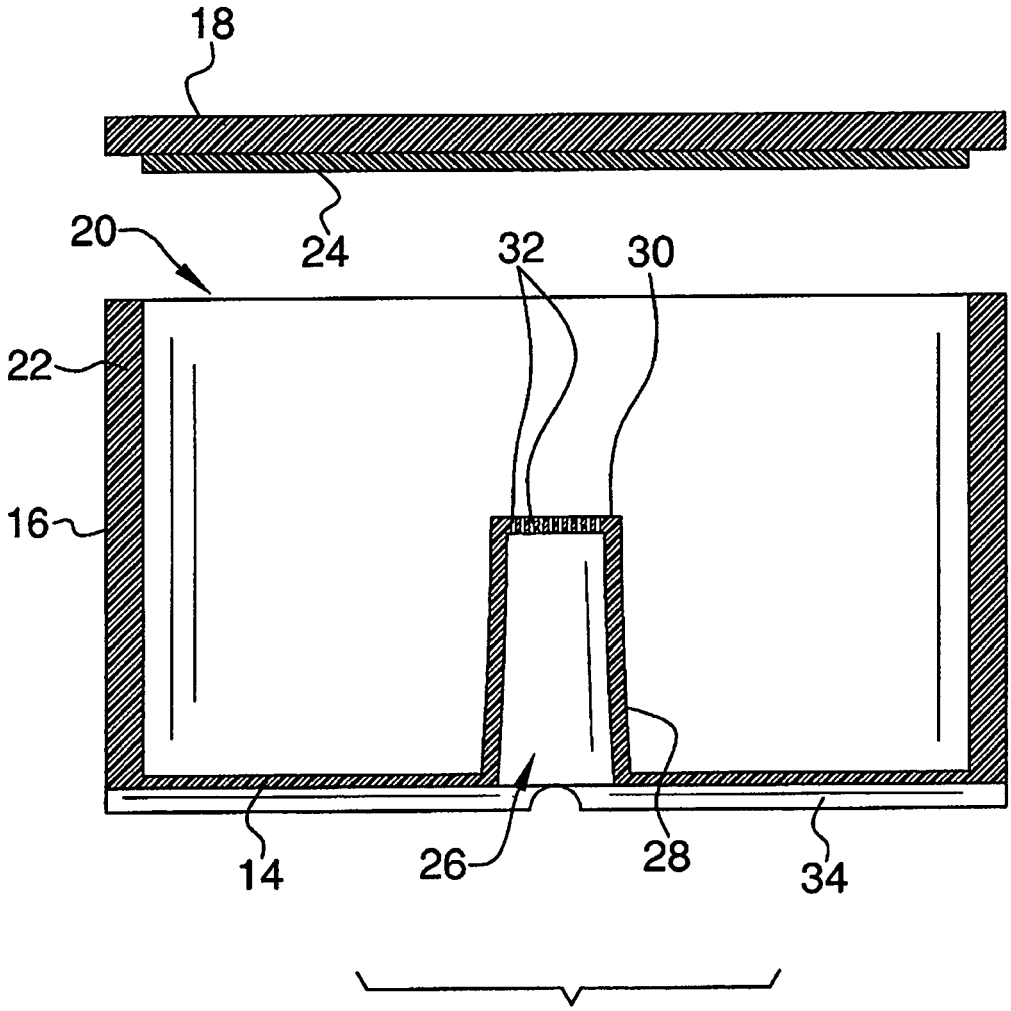
FIG. 6 is a cross-sectional view taken along line 6-6 of FIG. 5 of the present invention.
Figure 7:
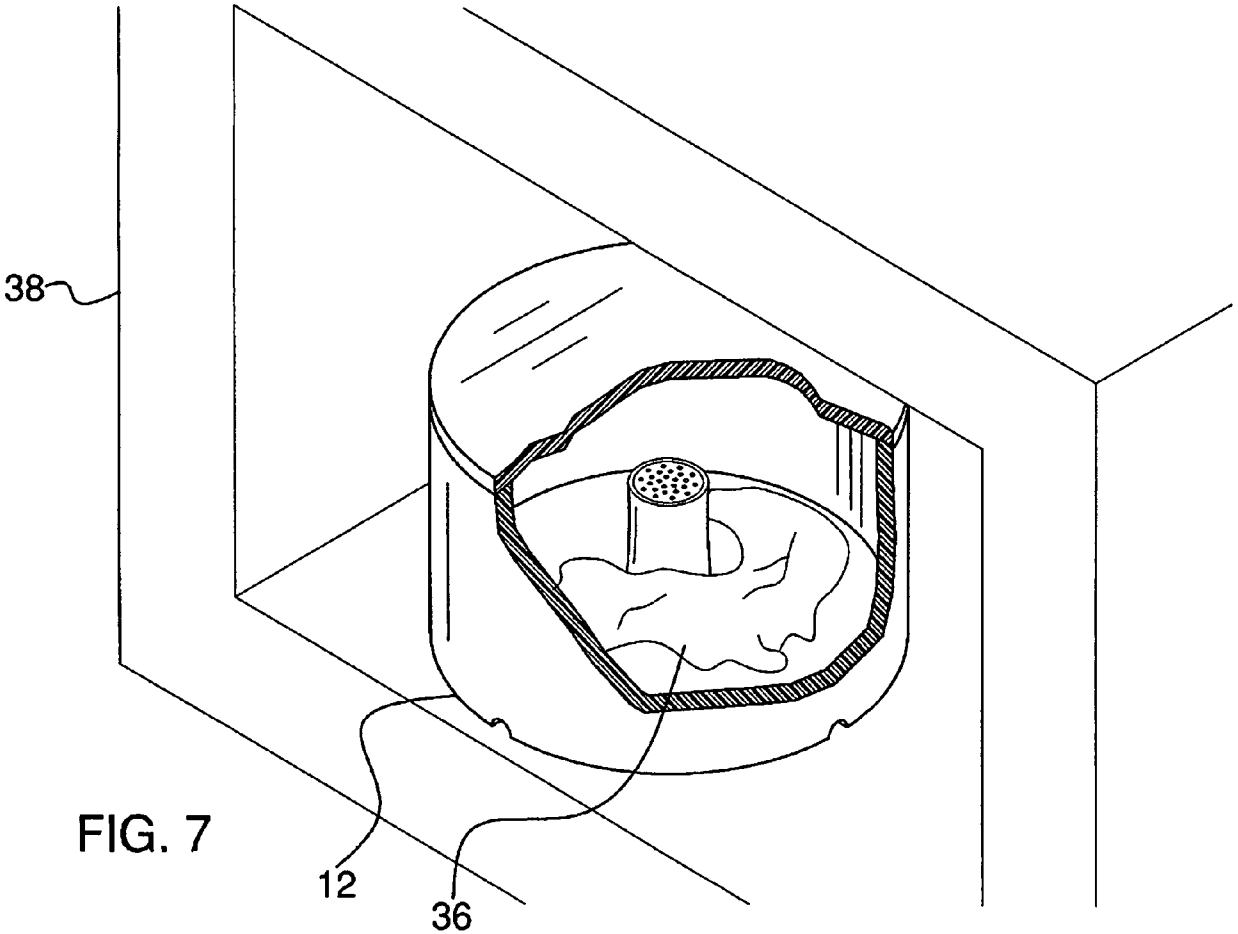
FIG. 7 is a perspective and broken in-use view of the present invention.

With reference now to the drawings, and in particular to FIGS. 1 through 7 thereof, a new wrinkle removing device embodying the principles and concepts of the present invention and generally designated by the reference numeral 10 will be described.

As best illustrated in FIGS. 1 through 7, the clothing wrinkle removal apparatus 10 and method generally comprises a housing 12 that has a bottom wall 14 and a perimeter wall 16 that is attached to and extends upwardly from the bottom wall 14. The housing 12 includes a cover 18 that is removably coupled to the perimeter wall to cover an access opening 20 into the housing 12 defined by an upper edge 22 of the perimeter wall 16. The cover 18 may include a shoulder 24 that frictionally engages an inner surface of the perimeter wall 16. The housing 12 has an internal volume between 0.25 cubic feet and 1.0 cubic feet and the perimeter wall 16 has a height between 0.375 feet and 1.0 feet. The bottom wall 14 has a circular shape and has a diameter between 0.5 feet and 1.0 feet.

The housing 12 has an air passage opening 26 therein. A peripheral wall 28 is attached to a peripheral edge of the air passage opening 26 and extends inward of the housing 12. The peripheral wall 28 has a distal end 30 with respect to the air passage opening 26. The distal end 28 includes an end wall closing the air access opening 28 and through which extends a plurality of air apertures 32 to allow air to pass between an exterior and an interior of the housing 12. The air passage opening 26 is in the bottom wall 14. The bottom wall 14 has a plurality of channels 34 therein extending from the perimeter wall 16 to the air passage opening 26 to allow air to travel under the housing 12 and to the air passage opening 26.

The method of using the apparatus 10 further includes positioning an item of clothing 36 within the housing 12. The user may or may not place a quantity of water in the housing 12 as well. Further, the water may be scented or a scent used by itself to impart the scent into the clothing 36. The cover 18 is then positioned on the housing 12 and the housing 12, along with the clothing 36 inside, is placed a microwave oven 38. The microwave oven 38 is then turned on for a selected amount of time to vaporize the water and steam the item of clothing 36. However, the clothing 36 will become warm without the addition of the water due to water vapor in the air and trapped in the clothing 36 and therefore the water may not be needed or used. The selected amount of time is generally between 15 seconds and 45 seconds and should typically not be more than 60 seconds. The apertures 32 allow for air flow through the housing 12 and to allow steam to escape before too great of pressure is built up within the housing 12. The housing 12 is then removed from the microwave oven 36 and the item of clothing 36 removed from the housing 12. The item of clothing 36 may be laid out flat while it cools to further remove wrinkles from the clothing 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of removing wrinkles from an item of clothing, said method including the steps of:

providing a housing having a bottom wall and a perimeter wall being attached to and extending upwardly from said bottom wall, said housing including a cover being removably coupled to said perimeter wall to cover an access opening into said housing defined by an upper edge of said perimeter wall, said housing having an air passage opening therein to allow air to move between an interior of said housing and an exterior of said housing;

positioning an item of clothing within said housing;

positioning said cover on said housing;

placing said housing within a microwave oven;

turning said microwave oven on for a selected amount of time to heat the item of clothing; and removing the housing from the microwave oven and removing the item of clothing from said housing.

2. The method according to claim 1, wherein the step of providing said housing further includes a peripheral wall being attached to a peripheral edge of said air passage opening and extending inward of said housing.

3. The method according to claim 2, wherein the step of providing said housing further includes said peripheral wall having a distal end with respect to said air passage opening, said distal end comprising an end wall closing said air access opening, said end wall having a plurality of air apertures extending therethrough to allow air to pass between an exterior and an interior of said housing.

4. The method according to claim 3, wherein the step of providing said housing further includes said air passage opening being in said bottom wall, said bottom wall having a plurality of channels therein extending from said perimeter wall to said air passage opening to allow air to travel under said housing and to said air passage opening.

5. The method according to claim 1, wherein the step of providing said housing further includes said housing having an internal volume between 0.25 cubic feet and 1.0 cubic feet.

6. The method according to claim 1, wherein the step of providing said housing further includes said air passage opening being in said bottom wall, said bottom wall having a plurality of channels therein extending from said perimeter wall to said air passage opening to allow air to travel under said housing and to said air passage opening.

7. The method according to claim 6, wherein the step of providing said housing further includes said housing having an internal volume between 0.25 cubic feet and 1.0 cubic feet.

8. A method of removing wrinkles from an item of clothing, said method including the steps of:

providing a housing having a bottom wall and a perimeter wall being attached to and extending upwardly from said bottom wall, said housing including a cover being removably coupled to said perimeter wall to cover an access opening into said housing defined by an upper edge of said perimeter wall, said housing having an air passage opening therein, a peripheral wall being attached to a peripheral edge of said air passage opening and extending inward of said housing, said peripheral wall having a distal end with respect to said air passage opening, said distal end comprising an end wall closing said air access opening, said end wall having a plurality of air apertures extending therethrough to allow air to pass between an exterior and an interior of said housing, said air passage opening being in said bottom wall, said bottom wall having a plurality of channels therein extending from said perimeter wall to said air passage opening to allow air to travel under said housing and to said air passage opening, said housing having an internal volume between 0.25 cubic feet and 1.0 cubic feet, said perimeter wall having a height between 0.375 feet and 1.0 feet, said bottom wall having a circular shape;

positioning an item of clothing within said housing;

placing a quantity of water in said housing;

positioning said cover on said housing;

placing said housing within a microwave oven;

turning said microwave oven on for a selected amount of time to vaporize the water and steam the item of clothing; and removing the housing from the microwave oven and removing the item of clothing from said housing.

* * * * *